US008083918B2

(12) United States Patent
Schmidlin

(10) Patent No.: US 8,083,918 B2
(45) Date of Patent: Dec. 27, 2011

(54) PROCESS AND DEVICE FOR THE PRODUCING AND RECYCLING OF NANOEMULSIONS AS WELL AS FOR THE SURFACE TREATMENT OF PARTS BY MEANS OF THE SAME

(75) Inventor: Edgar Schmidlin, Matzingen (CH)

(73) Assignee: Claudia Marcoli, Illnau (CH)

( * ) Notice: Subject to any disclaimer, the term of this patent is extended or adjusted under 35 U.S.C. 154(b) by 1172 days.

(21) Appl. No.: 11/891,478

(22) Filed: Aug. 11, 2007

(65) Prior Publication Data

US 2008/0060934 A1 Mar. 13, 2008

Related U.S. Application Data

(63) Continuation of application No. PCT/CH2006/000089, filed on Feb. 10, 2006.

(30) Foreign Application Priority Data

Feb. 11, 2005 (CH) ..... 262/05

(51) Int. Cl.
*B01F 11/00* (2006.01)
*B05D 1/00* (2006.01)

(52) U.S. Cl. ..... 204/554; 204/660

(58) Field of Classification Search ..... 204/554, 204/660

See application file for complete search history.

(56) References Cited

U.S. PATENT DOCUMENTS

| | | | | |
|---|---|---|---|---|
| 5,152,923 | A * | 10/1992 | Weder et al. | 516/56 |
| 2006/0163385 | A1* | 7/2006 | Link et al. | 239/424 |
| 2006/0164912 | A1* | 7/2006 | Arnaud | 366/108 |
| 2006/0251684 | A1* | 11/2006 | Annis et al. | 424/400 |

* cited by examiner

*Primary Examiner* — Harry D Wilkins, III
*Assistant Examiner* — Bryan D. Ripa
(74) *Attorney, Agent, or Firm* — CUSPA Technology Law Associates; Yi Li

(57) ABSTRACT

The invention relates to a device comprising a tubular circuit provided with at least one pump (9), a vacuum chamber (1) for processing the surfaces of parts placed therein, an actuation device (10), high voltage electrodes and a high frequency coil comprising a separate generator provided with a frequency converter for producing an electric field. The inventive device also comprises a transversal resonator for producing an aerosol and injection nozzles for spraying said aerosol into the vacuum chamber (1). The emulsion crosses the actuation device (10) in which electric and electromagnetic fields of 1-10000 volts, whose superimposed frequencies ranging from 10 Hz to 1 GHz are produced by a high-voltage electrode and the high frequency electromagnetic coil with the aid of the generator. By superimpose in the fields, a potential Zeta variation generates the transformation of a microemulsion into a nanoemulsion for processing part surfaces.

8 Claims, 7 Drawing Sheets

Figure 1:
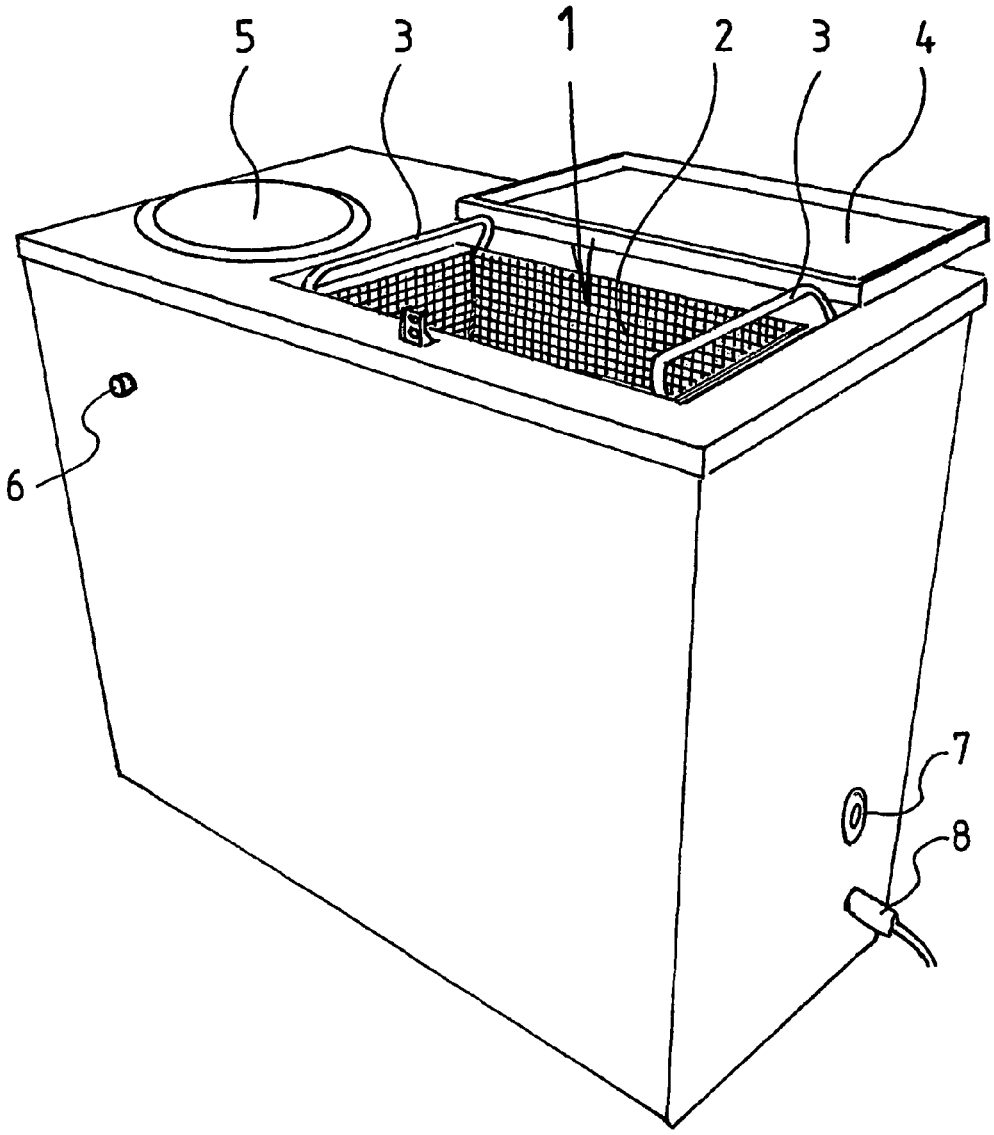

PROCESS AND DEVICE FOR THE PRODUCING AND RECYCLING OF NANOEMULSIONS AS WELL AS FOR THE SURFACE TREATMENT OF PARTS BY MEANS OF THE SAME

CROSS REFERENCE TO RELATED APPLICATION

This application is a continuation of PCT patent application No. PCT/CH2006/000089, filed on Feb. 10, 2006, which claims the priority of Switzerland patent application No. 262/05, filed on Feb. 11, 2005. All prior applications are herein incorporated by reference in their entirety.

The invention relates to the process and a device in the form of an electromechanical device with which microemulsions can be converted into nanoemulsions and process-controlled into various phases so that a surface treatment of materials is possible in a vacuum chamber through the multiphase process, especially an optimal coating and coating removal of organic as well as inorganic solids. The emulsions are again recycled afterwards.

A microemulsion is a thermodynamically stable, isotropic, low viscosity mixture, which consists of a hydrophilic component and a lipophilic component. The hydrophilic character of a substance is determined by its property to dissolve in water. (Conversing: hydrophobic=water repelling). Lipophilic characterises the property of compounds or molecular groups to dissolve slightly in fats, fatty substances and oils or to serve as solvent themselves for such substances, while on the contrary lipophobic (fat repellent) materials act in the opposite way. The electrical and electromagnetic system of the device proposed here effect modifications to the diffuse interphase of a so-called Stern double layer of the particles within the emulsions. This Stern double layer is made up of a fixed and a diffuse layer. According to the theory of Otto Stern (1888-1969), Nobel price winner Physics, a potential builds up due to the charge distribution, which decreases linearly in the fixed and exponentially in the diffuse layer. The respective Zeta potential of an emulsion is important for the functional effect at the diffuse interphase, which describes the stability of a microemulsion or an individual micelle. The Zeta potential is therefore a measure for the repulsion or attraction between particles and a micelle is a colloidal particle, which is made up of a number of small individual molecules.

One would want to keep the loss as small as possible in electrical insulations of high frequency carrying conductors or in insulations in high frequency fields. For that, one uses materials, which produce in such fields as small an effective power as possible and thus lead to low losses. Conversely, one selects microemulsions in such a way that as high losses as possible and consequently desired modifications arise within, i.e. at the micelle surfaces. Hence an option is available to be able to influence the structure of micelles in a controlled and regulated way so that they have acceptable kinetic conditions, which enable an coating removal as well as a coating of materials in the molecular range. A system for such purposes works with a continuous-flow process, which permits an activation using as less energy as possible. There is additionally the option to merge the medium to be treated with the different charges in a vacuum chamber such that a charge equalisation, i.e. a conversion of the microemulsion to a nanoemulsion, takes place adjacent to the surface of the material to be treated.

The task of the present invention is to produce a device for the surface treatment of parts by means of recyclable nanoemulsions as well as to indicate a process for the creation and application of the nanoemulsions in a multiphase interface treatment as well as for the recycling of the nanoemulsions.

This problem is solved by a process for the production, application and recycling of nanoemulsions as well as for the surface treatment of parts by means of the same, for which a nanoemulsion is produced, in which an emulsion flows through an actuation device, in which electrical and electromagnetic fields produced by a high frequency electrode and electromagnetic high frequency coil by means of generators are superimposed on each other and resonances are produced by means of selectable voltages, frequencies and phase shifts so that, as a result of the modification of the particle double layers, which causes a variation of the Zeta potential, a microemulsion transforms to a nanoemulsion, with which the surfaces of parts are treated afterwards in a vacuum chamber and is recycled afterwards in the recycling system and then reused.

The problem is further solved by a device for the production, application and recycling of nanoemulsions as well as for the surface treatment of parts by means of the same, consisting of a closed loop with minimum one pump for the supply of an emulsion to a circuit, this closed loop containing a vacuum chamber for the surface treatment of parts therein, in which the closed loop runs through an actuation device, as well as a high voltage and a high frequency coil with separate generator each with frequency converter for the production of an electrical field, in which separate fields can be produced from it for the conversion of a microemulsion to a nanoemulsion, and the device further includes a transversal resonator for the production of an aerosol as well as injection nozzles for the spraying of the aerosol-/nanoemulsion mixture into the vacuum chamber.

A device is represented in the drawings as example with its essential elements in different views and is described below on the basis of these drawings and the process operated with that is explained. The physical process sequences in the course of the coating removal process are explained on the basis of schematically, greatly enlarged representations.

Figure 2:
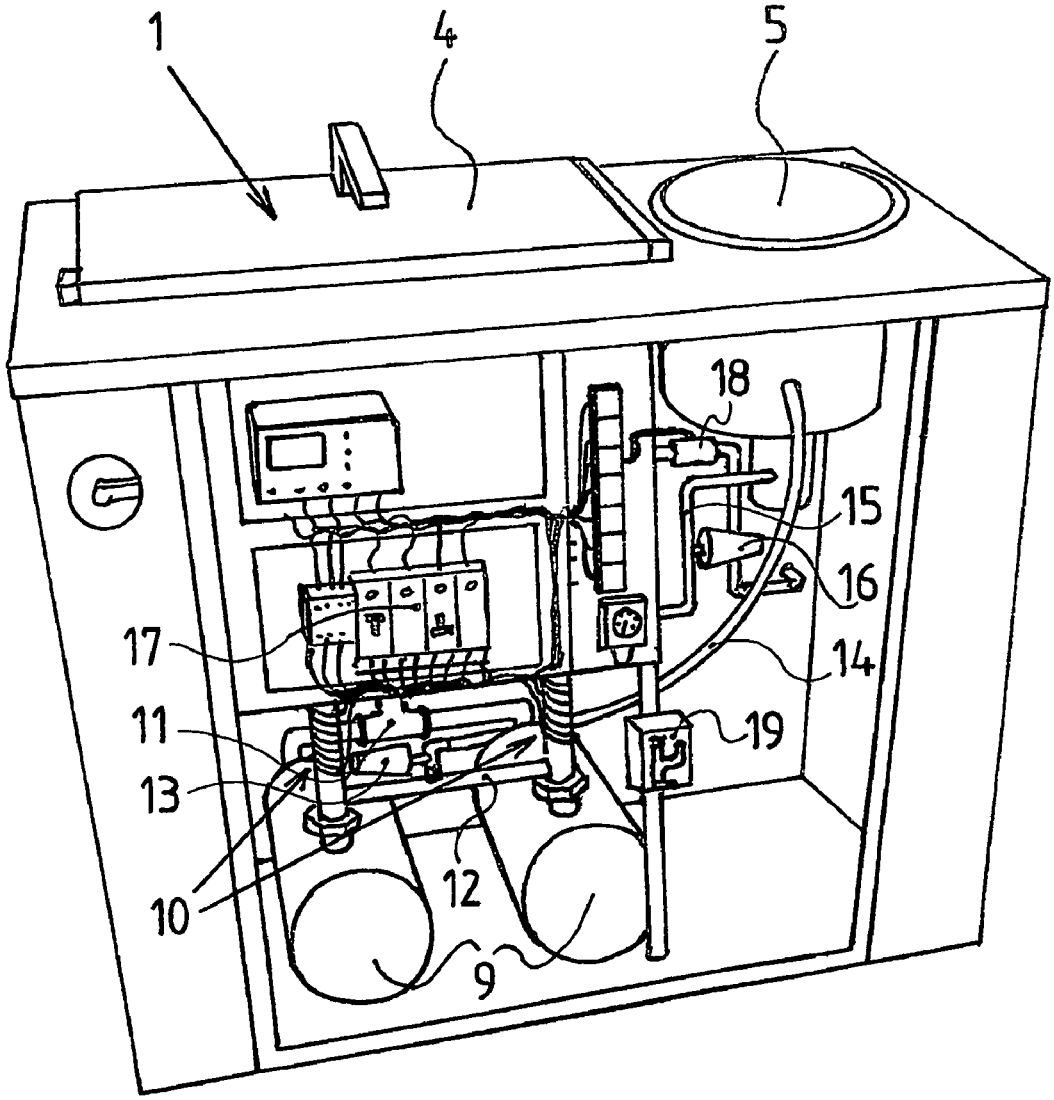
Figure 3:
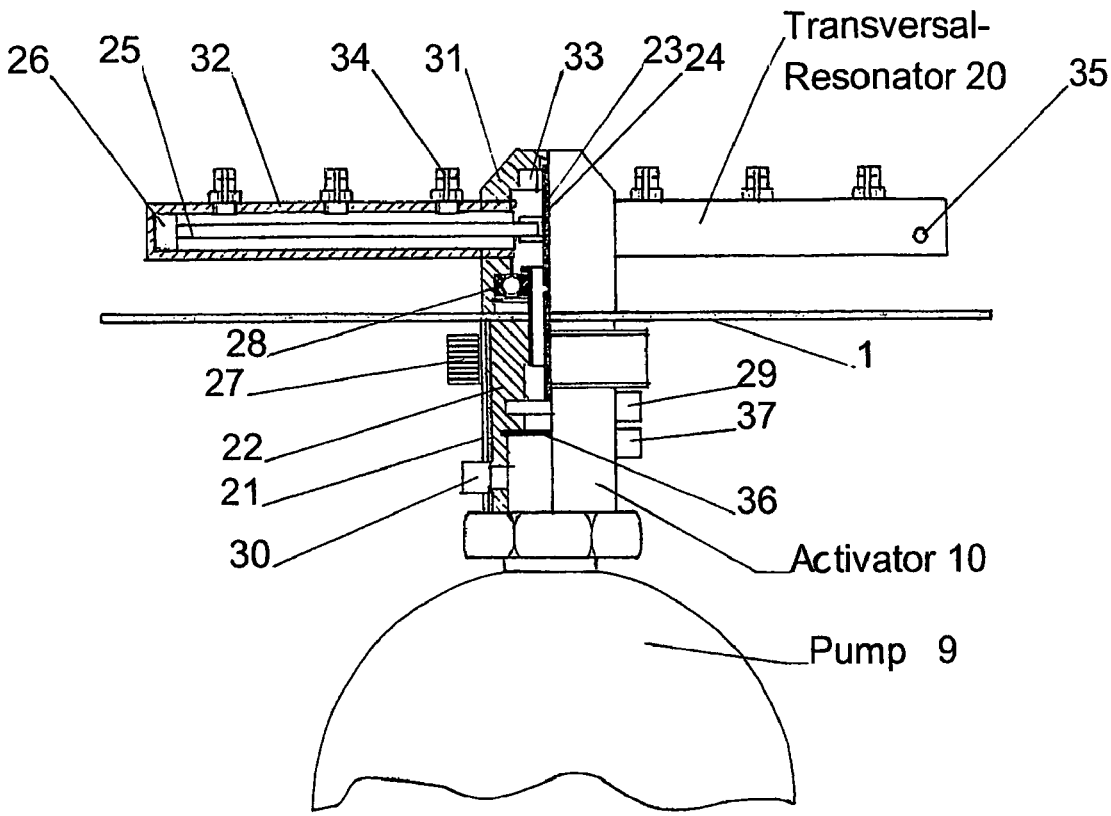
Figure 4:
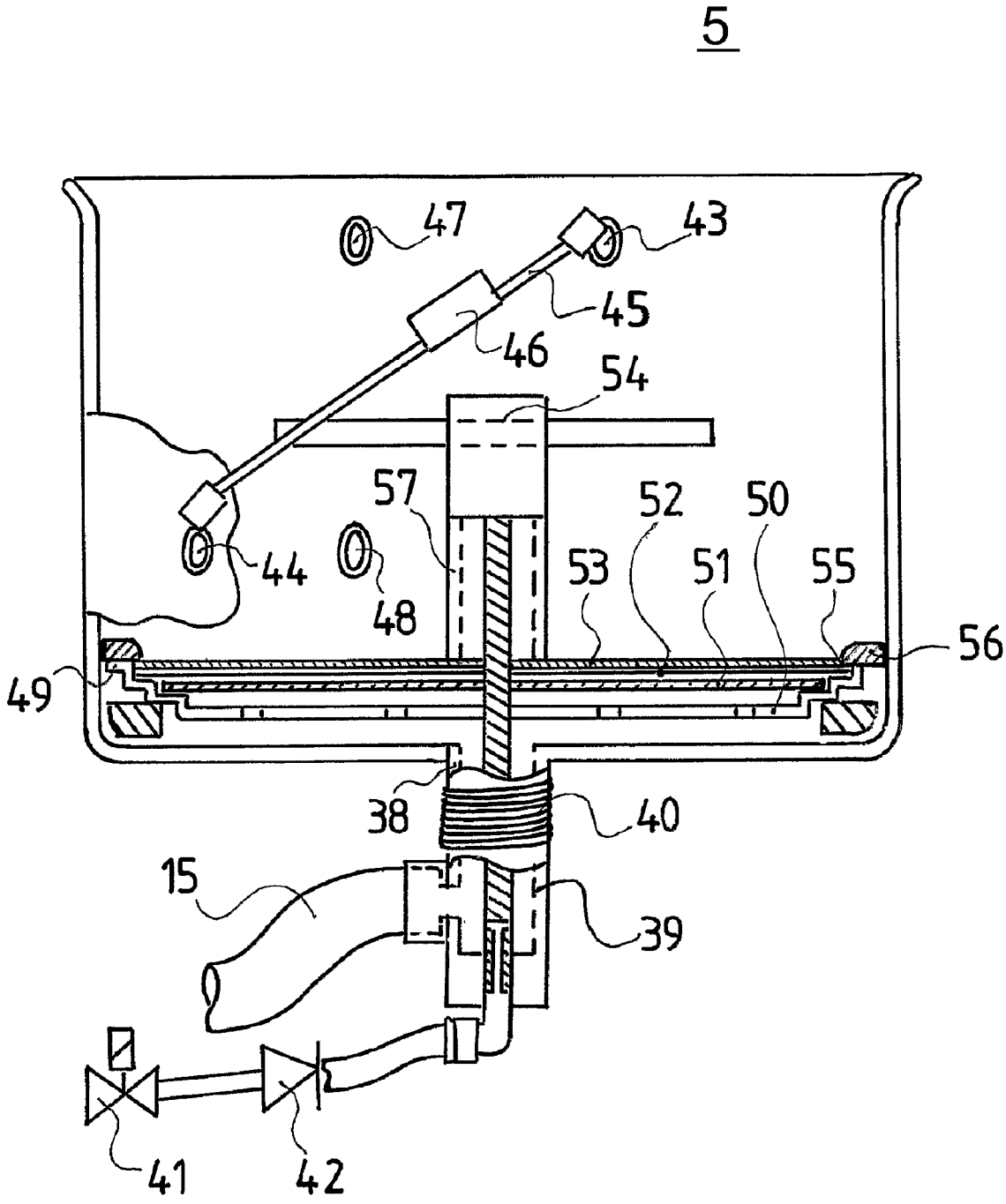

The following are shown:

FIG. 1: The device in a view seen from behind;

FIG. 2: The device in a view seen from the front, with front-side cover removed;

FIG. 3: Activation device with a pump outlet and a transversal resonator;

FIG. 4: A cross-section through the recycling system;

FIGS. 5-10: The different phases of an coating removal by means of nanoemulsion represented schematically and greatly enlarged.

In order to be able to describe and understand the device and the process operated with it better, at first a small digression about microemulsions is given here: These microemulsions can be formed as purely organic or aqueous organic. For the purely organic microemulsion, a carrier liquid is used, which consists of one or more types of molecules. On the other hand, for the aqueous microemulsions, the carrier liquid consists of water.

The carrier liquids are now added with several surface-active materials, that is materials, which go into physically-based bond with their surfaces in binding with another material. These materials form so-called micelles in the carrier liquid by self-organisation. According to the task, surface-active materials are used in addition, which form monomolecular or bimolecular micelles. Such tensides are soluble organic compounds, which lower surface tension. They have minimum one hydrophobic molecular part and one hydrophilic group.

Basic assumption for the stability and the molecular self-organisation of the treatment liquid is that molecular, surface-active materials in the carrier liquid are not soluble. Enzymes are used for the setting and changing of the interfacial kinetics of the double layer of the nanoparticles.

There are various surface-active and non-ionic agents available for the formation of the organic and the aqueous microemulsions. These can be roughly classified into:

Anionic materials
Cationic materials
Non-ionic materials
Amphoteric materials.

Anionic surface-active materials can form micelles with a negative charge. Cationic surface-active materials can form micelles with a positive charge. Non-ionic surface-active materials can form micelles with a zero charge. Amphoteric surface-active materials can form micelles with a negative or positive charge. For all these materials, the charge strength depends on the Zeta potential. The type of charge is determined by electrical and magnetic forces, which are effective at the system surface.

The amphoteric active materials are used in coating removal and coating systems, for which very short conversion times are required. Due to this reason, these materials are especially well suited for the present process. They can be recharged in fractions of seconds using magnetic and electric phase control with the proposed device. The charging possibilities move between negative (anionic), zero potential (neutral) and positive (cationic). The Zeta potential can be controlled and regulated at a Stern double layer independent of the chemical potential through suitable resonances with this device and the process operated with that. Thereby, Zeta potential can be set from −15 to +15.

Further materials, which are used in microemulsions, are:

Enzyme
Organic and inorganic nanoparticles
Chiral terpenes

The enzymes can control the energy behaviour of micelles, nanoparticles and chiral molecules. Normally, they work as catalysts, which reduce the reaction energy between two systems. The enzymes are not depleted in the microemulsion. Nanoparticles, which are smaller than 20 nm in size, are highly reactive and can break through high energy barriers. In the microemulsion, they are important for the self-organised reaction in the individual phases of the coating and/or coating removal process. The chiral molecules (mainly terpenes) are responsible for the formation, enlargement and stabilising of the micro-capillaries, which will be gone into in more detail later.

The electrical properties of micelles are analogous to the kinetic properties to a certain extent. Since almost no electron conductivity is present in the micelles in comparison to the metals, the electrical properties to a certain extent, as also the mechanical properties, depend on the mobility of the molecular components of the micelles. Characteristic for these properties is the relative permittivity $\in_r$. One calls $\in_r$ the relative permittivity". The value of the relative permittivity of an insulating material is determined by the strength of the polarisation. It is dimensionless, but depends both on the material as well as on the temperature and the frequency. So-called polarisation charges arise at the surface of the micelles under the influence of an electric field, which cause induction. Here, by induction, one means the separation of charges of a conducting body under the influence of the electrical forces exerted by external charges. The dielectric polarisation is the proportion of the dielectric flux density, which falls on the dielectric. The value of the dielectric polarisation P arises as per the relationship:

$$P=\in_0 \cdot E \cdot (\in_r - 1) \tag{1}$$

$\in_0$ electric constant ($\in_0$=8.854.10$^{-12}$ AsV$^{-1}$ m$^{-1}$)
$\in_r$ relative permittivity (relative dielectric constant)
E electric field strength It can be derived from the equation (1) that the polar behaviour and consequently P of a material depends on how large the relative permittivity is, for each salient one. If only a displacement polarisation is present, the relative permittivity is small. If, besides the displacement polarisation, an orientation polarisation also occurs additionally, the relative permittivity is larger. It can then reach values of 4 to 100. If there is a spontaneous polarisation, the peak values of even up to 100,000 can be reached as relative permittivity. But what exactly is polarisation? Real bodies consist of equal number of positive and negative electrical charges, on which an influencing electrical field exerts kinetic forces. Positive charges are accelerated in the field direction, negative against the field direction. Micelles have practically no freely movable charge carriers. The charges are bonded to carriers (Atoms, Molecular segments). They can be consequently displaced only elastically by an amount proportional to the field strength. The centres of gravity of the positive and negative charges therefore do not coincide any more; electrical dipoles are formed. For the electron polarisation, the external field causes a deformation of the electron shell of the atoms. It occurs for non-polar materials. For the pure electron polarisation, $\in_r=n^2$ (n=optical refractive index). Also, it practically does not change with the frequency, reduces with the temperature, since as a result of the thermal expansion, the number of polarisable particles becomes less. Since only the molecules used for the formation of micelles themselves or parts of them represent, permanent dipoles", they align themselves in electrical fields, so that macroscopic polarisation arises, which is higher for polar, surface-active materials than for nonpolar. The polarisation parts are also movable differently corresponding to the different mechanisms. Since the permanent dipoles are relatively large groups in micelles, they can follow only comparatively low frequencies. Of considerable practical interest is the question of the influence of colour pigments on the relative dielectric constant. The most important mixing rule is calculated approximately from the sum of the dipole moments of the colour pigments and those of the carrier matrix on the total charge density:

$$\varepsilon_{eff} = \varepsilon_{Matrix}\left(1 - 3p \cdot \frac{\varepsilon_{Matrix} - \varepsilon_{r,Pigment}}{2 \cdot \varepsilon_{Matrix} + \varepsilon_{r,Pigment}}\right) \tag{2}$$

in which p=Volume content

Thus, for example, the following arises for air inclusions (foam, flow zones, etc.) with $\in_{r,Luft} \approx 1$:

$$\varepsilon_{eff} = \varepsilon_{Matrix}\left(1 - 3p \cdot \frac{\varepsilon_{Matrix} - 1}{2 \cdot \varepsilon_{Matrix} + 1}\right) \tag{3}$$

and for metal inclusions with $\in_{r,metal} \approx \infty$:

$$\in_{eff} = \in_{Maxtrix}(1+3p) \tag{4}$$

The proposed process can be used in various applications in connection with a microemulsion. It functions for coating and coating removal in the nano range. The coating removals serve for example for the removal of wet and dried printing inks
removal of single or double component colours
removal of plastic coatings
removal of industrial dirt layers
etc.

The coatings serve for the modification of the conductivity of plastic surfaces
modification of surface energy of plastic surfaces, e.g. epilaminating, improvement of the sliding property, etc.
application of functional nanolayers on solids
etc.

The objective of the process is to convert a microemulsion into a nanoemulsion in the actuation device and create active electrical surface-double layers in the molecular or atomic area on the solid particles of the nanoemulsion with the help of the phase resonator through electromagnetic fields. Electrical double layers are responsible as is generally known for many physical kinetic phenomena like electro-osmosis, electrophoresis, streaming potentials and sedimentation potentials. The electrical kinetic forces, which act on electrically charged particles in a liquid, are designated as Coulomb forces. For the function of the process mentioned, which can be used for the layer formation and layer removal on solids, electrokinetic modifications are produced at the double layers of different systems through electrical and high frequency high voltage fields. Besides, a gas mixture is let into the actuation device. Thereby, an aerosol is produced from a portion of the nanoemulsion, which is sprayed into the vacuum chamber together with the remaining nanoemulsion with the rotating injection nozzles of the transversal resonator. A parabolic, asymmetric, transversal superimposed rotation field is produced in the vacuum chamber through the rotating transversal resonator. The double layers of the sprayed particles react in this field and form functional resonances in the individual process phases. Various functional single- or multiphase processes are used for the coating and coating removal process.

A decisive role for the multiphase process is, among others, the influence of the composition of the used microemulsion as well as the program-controlled reaction technique in the actuation device or in the phase resonator. Isolated active and energy-rich centres with electrokinetic charges are formed in the individual phases with the phase resonator, with which the structure of the organic layer to be removed is modified. The molecules, enzymes and nanoparticle surface atoms are dissolved in these active centres and effective, intermolecular forces are produced in the organic layer. Different interactions arise between the layer molecules, which are described in more detail in the four phases of the multiphase coating removal system. A special feature of this process is the self-organisation of nanoparticles, which is formed through the adsorption of ions and through self-dissociation. Nanoparticles, which are in this condition, can lead to system instabilities in contact with ionic surface. This effect is operative in phase 4 described below for the removal of large layer agglomerations. A further effect, which is used in the process of the phase 1 described below, is the arising of matter waves, which form a network of split-capillaries in the organic layer. One knows from the formation appearance of the electrons and neutrons that material particle properties come from matter waves, if the molecular force constants are very large (Extension of the Maxwell relation for the translational energy). In contrast to the electromagnetic waves or protons, the velocity of propagation is different from the particle speed for matter waves. For the creation of a particle beam through an infinitely long wave train, the impulse of the particle is uniquely determined by the wavelength. The spot, which captures or runs through a particle at a particular point of time, is however fully uncertain. In order to be able to mark the local place of a particle, which penetrates into the organic layer, at least approximately, one must consider a wave packet. Such a wave packet arises through superimposition of many wave trains, in which the wavelength and the amplitude are so selected that interferences are caused. The uncertainty of the local position of the particle is narrowed down with the help of a wave packet, which is used in the phase 3 described below. However, this is possible only at the cost of the certainty in the indication of the impulse. The wave character of material particles brings therefore a basic lack of certainty for the simultaneous indication of location impulse of a particle (Uncertainty relation, Physicist Werner Heisenberg, 1927).

A specific embodiment for the use of such nanoemulsions is the cleaning of tampon printing press implements. For this, a device is used, which is represented in FIG. 1 from behind. It is produced from chrome steel and has a vacuum chamber 1 accessible from above, in which a treatment basket 2 with two handles 3 can be introduced. Implements to be cleaned, that is, in the proposed example tampon printing plates, are placed in this basket 2 and thereafter placed in the vacuum chamber 1. Many times, only a grid is used instead of the treatment basket 2 for the taking up of the cleaning material. The vacuum chamber can be closed with a cover 4, which is fixed to this with the help of hinges on the upper side of the device. The operator stands on the front side of the device, that is, on the side turned away from here in this diagram. The cover is thus, starting from the closed condition, swung towards the front and forms after that a placement area for the treatment basket 2 or the cleaning material lifted out of the vacuum chamber.

Besides the vacuum chamber 1, one can recognise a recycling system 5, in which the microemulsion is freed of the colour, as is described in detail later. On the backside of the device, there is an opening 6 for the exhaust air, which arises during the creation of the vacuum in the vacuum chamber 1. An internal exhaust air system or an active carbon filter can be connected to the opening 6. On the small side of the device, there is in addition a compressed air connection 7 and an electrical connection 8.

In FIG. 2, one sees the device in a view from the front, with the front-side cover removed. Two circulation pumps 9 can be recognised under the vacuum chamber 1. An actuation device 10, which cannot be seen fully here, is connected to each pump outlet. This actuation device 10 is connected respectively to the corresponding transversal resonator (not visible here) in the vacuum chamber 1 with the help of a threaded connection. In the floor of the vacuum chamber I is the drain outlet, which is connected to the pump inlets via a T-joint 11 and a threaded connection each. The circulation pumps 9 supply the microemulsion then via the activation units 10 to the transversal resonators, where it is sprayed as aerosol/nanoemulsion mixture into the vacuum chamber on the cleaning material. The microemulsion leaves the vacuum chamber 1 via a drain outlet, which is connected to the circulation pumps 9 via the T-joint 11 and the connection pipes. This cleaning circuit described can thus also be operated alternatively with one or more than two pumps according to the cleaning requirement. Besides the cleaning circuit, the device contains in addition one circuit for the recycling. The two actuation devices 10 are connected with each other for that via a connecting pipe 12. In its middle there is a valve 13, which after switching on feeds a part of the emulsion to the recycling system 5 for the recycling via the tube 14. After the recycling process, the now clean microemulsion is again supplied to the vacuum chamber 1 via the pipe 15 and the valve 16. Air is blown in from below to the recycling system 5 for a back flushing with valve 16 closed. The back flushing is gone into in detail in FIG. 4. Above the actuation devices 10, one can recognise the electric network 17 belonging to the device, which is provided on the outside of the vacuum chamber 1. The generators for the operation of the electrodes and the coils as well as the phase discriminators also belong to this electric network 17. High voltage fields of 1 to 10,000 Volt can be produced with these generators with superimposed frequencies from 10 Hz to 1 GHz. A vacuum valve 18 can be recognised to the right of the vacuum chamber. The vacuum valve 18 has the task to set the vacuum chamber 1 under vacuum and to conduct the exhaust air via the opening 6 (FIG. 1). The 3/2 directional control valve 19 serves for the aeration and de-aeration of the recycling system 5 as well as the aeration of the vacuum chamber 1.

The FIG. 3 shows in an enlarged view the outlet of a circulation pump 9, an actuation device 10 and a transversal resonator 20. The microemulsion is converted to a nanoemulsion with the help of the actuation device 10. The individual process steps for the 4-phase process is produced with the rotating transversal resonator 20. The actuation device 10 is at the pump outlet 9, fixed with a 1"-threading. The actuation device 10 consists of a shielding housing 21, consisting of a pipe, which is welded on to the floor outlet of the vacuum chamber I. An insulator 22 is assembled in the shielding housing 21. In the middle of the insulator 22, i.e., in the liquid inlet, there is one or two high voltage electrodes 23 and two sliding contacts 24. The high voltage electrode 23 is connected to the wave guides and the permanent magnets 26 via a sliding contact 24 each. An electromagnetic high frequency coil 27 is fitted outside the shielding housing 21. In the upper part of the insulator 22, which projects into the vacuum chamber 1, there is a ball bearing 28 and a fastening thread for the transversal resonator 20. At the lower end, below the high frequency coil 27, is the connection 29 for the high voltage electrode 23. On the opposite side is the inlet 30, via which gaseous, vaporous or liquid active agents can be lead into the system. The transversal resonator 20 consists of a cylindrical rotating part 31 of plastic or ceramic with internal thread for the fixing to the activation unit 10 and two threads provided sideways for the hollow nozzle bars 32 of plastic. One or more ring permanent magnets 33 are assembled in the upper part. One or more injection nozzles 34 each are screwed into the nozzle bars 32 while there is one hole 35 below which is slightly displaced sideways. The transversal resonator 20 rotates around its axis through the outflow of the nanoemulsion from the two holes 35. One wave guide 25 each of tungsten or stainless steel is fixed in the hollow nozzle bars 32 in the middle, which is closed on outer side with a permanent magnet 26. The wave guides 25 are connected on the inner side with a sliding contact 24 each to the actuation device 10. In the lower part of the activation unit 10, there is a membrane as phase resonator 36, which is provided with a high voltage/high frequency generator via the connection 37 for the production of nanoparticles with definite sizes.

The microemulsion is freed from the colour absorbed continuously in the recycling system 5. The recycling system 5, which can be seen in FIG. 2, is represented in FIG. 4 in a cross-section. It is a pot of chrome steel. In principle, a usual chrome steel digester can be used as recycling system 5. There is an outlet opening 38 in the pot floor. A distributor 39 with an electromagnetic discharge coil 40 is fixed at this outlet opening 38. The task of the discharge coil 40 is to reset the microemulsion again to a defined condition. An air inlet valve 41 is assembled to the distributor 39 below the coil 40 with non-return valve 42 interposed for the back flushing. The clean microemulsion leaves the recycling system 5 via the pipe 15, which is provided likewise at the distributor 39. Four inlets 43, 44 and 47, 48 are pressed in with threads sideways to the pot. The inlets 43 and 44 are connected with a tube 45. There is an adjustable capacitive level sensor 46 for the level control. The upper inlet 47 is connected with a 3/2 directional control valve to the compressed air inlet via a nylon tube. The lower inlet 48 is connected with the tube 14 to valve 13. A part of the microemulsion is fed to the recycling system 5 for the recycling via this tube 14. A separating plate 49 is put inside in the recycling system 5. This separating plate 49 is fixed with a T-shaped fixing unit 54 on a sealing ring 55 on the pot floor. It consists of a metal tray 50 with twelve discharge holes. A stainless steel nose plate 51 is welded to the metal tray 50 as spacer. A Piezo foil 52 of coated stainless steel wire gauze or plastic cloth lies on that. Alternatively, an electrode consisting of a wire gauze, which is supplied with high voltage from an external generator, can also be put in. A fine-mesh stainless steel grid 53 lies over the Piezo foil 52 or the high-voltage electrode. The parts put in are fixed at the rim insulated against the metal tray 50 with a high-ohmic sealing compound 56. In the middle of the separating plate 49, there is a stainless steel lug with hole 57 for the fixing and removing. The separating plate 49 has, besides the assembly of a liquid/liquid double layer for the colour separation, the task to prevent the outflow of the fine-grained adsorber.

For the first commissioning or after a colour removal, at first a measuring beaker adsorber or a unit of vacuum-packed adsorber paste is added to the recycling system 5. The adsorber consists of various organic and inorganic substances, which are so selected that they can release the costly active agents of the microemulsion again through exchange during the recycling. After the addition of the adsorber, the recycling system 5 is closed tightly, for which the relevant cover can be used in the case of a digester. After the starting of the cleaning process, the recycling of the emulsion is active in parallel to that. At first the back flushing is started in the recycling system 5 for that. It mixes the adsorber with the dirty emulsion. During the cleaning process, the recycling system 5 is filled cyclically with dirty emulsion via the valve 13. The filling volume is determined by the capacitive level sensor 46. During the mixing with the adsorber, the molecular active agents bonded to the colour agglomerations are again released and replaced by adsorber molecules. The released active agents again form micelles partially and receive a negative charge. A liquid/liquid separating layer is formed between the adsorber and the separating plate with a negative field voltage through the pressure and/or vacuum acting on the Piezo membrane. The field voltage (high voltage) forms an electrostatic filter and separates the positively charged colour agglomerations from the negatively charged microemulsion. The microemulsion freed from the colour leaves the recycling system 5 via the discharge opening 38 present on the floor. The colour residues bonded to the adsorber however remain until the colour removal in the pot. For the passage of the microemulsion through the electromagnetic discharge coil 40, the micelles are again transferred back to the original state according to their charge. Afterwards, the regenerated microemulsion is again fed to the vacuum chamber 1 via the pipe 15 and through the valve 16. The separated colour quantity is monitored periodically and/or through a sensor with regard to the quantity. If the maximum permitted colour quantity is reached, a colour removal process is carried out automatically. For that, the recycling system 5 is emptied and the residual substance dried with air from the inlet 47. After the end of this process, the cover is opened by hand and the separating plate 49 removed manually with the powdered and dried colour residues bonded to the used adsorber. After the removal of the residues, the separating plate 49 is again used in the recycling system 5 and screwed firmly with the T-shaped fixing unit 54. A new cleaning process can be started only if the recycling system 5 is filled again with adsorber afresh and the cover has been closed. The recycling system permits a time-wise practically unlimited use of the microemulsion. Only the carry-over losses have to be replaced from time to time.

Figure 5:
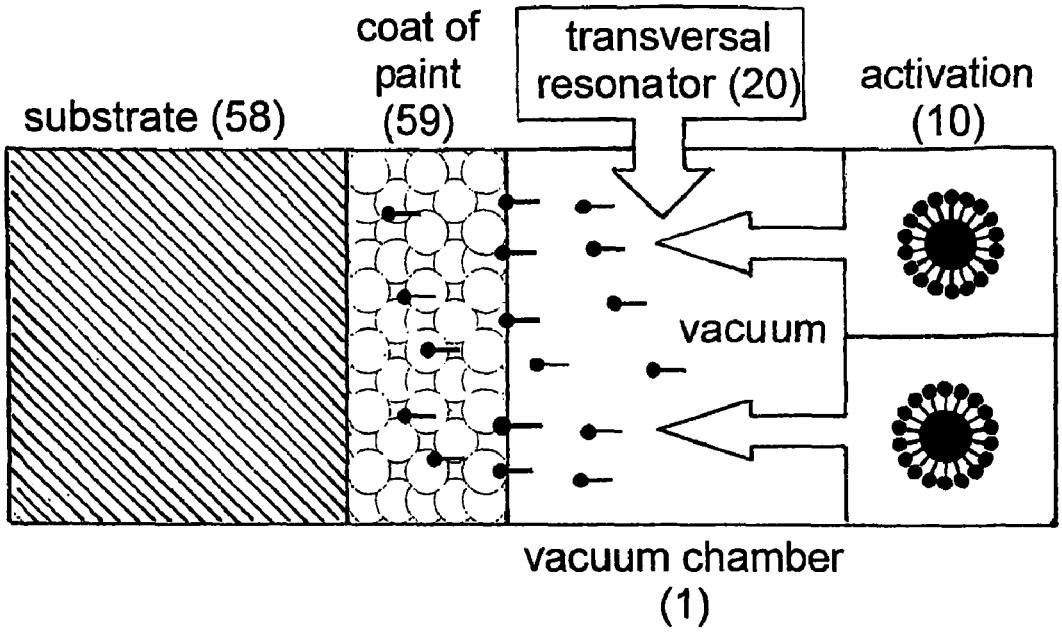
Figure 6:
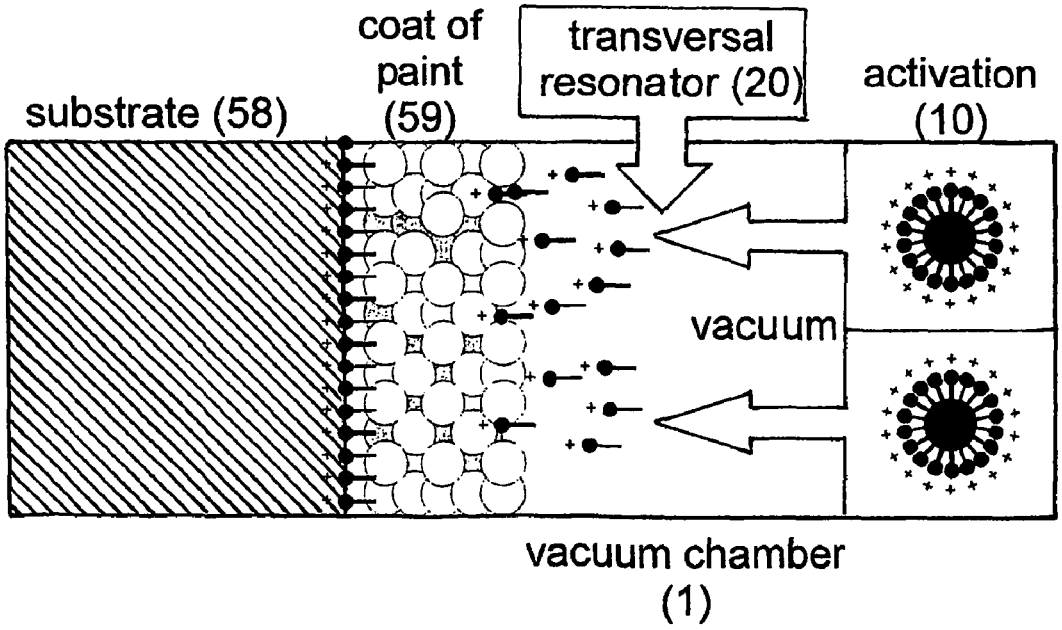
Figure 7:
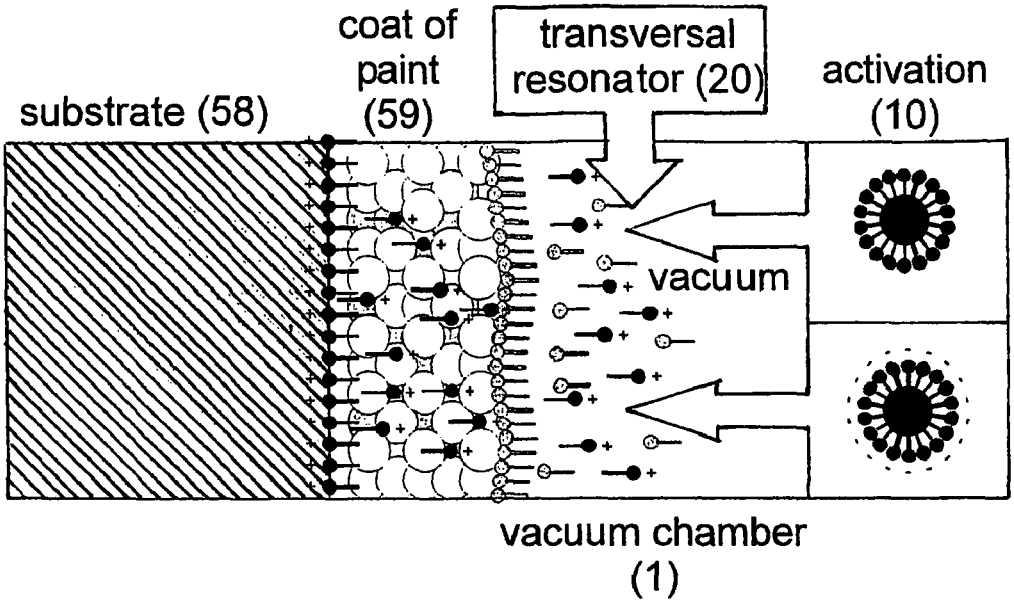
Figure 8:
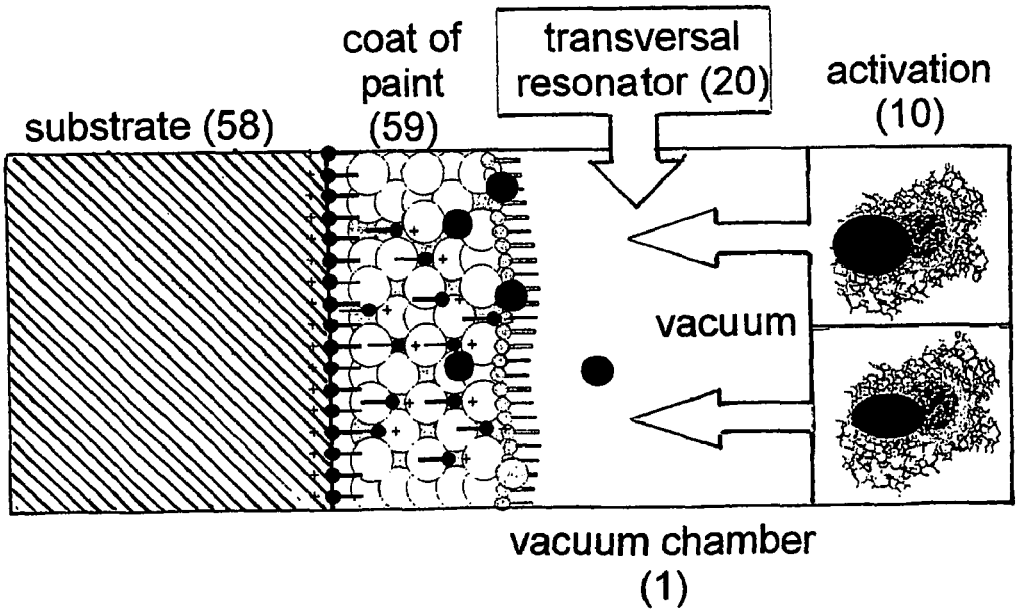
Figure 9:
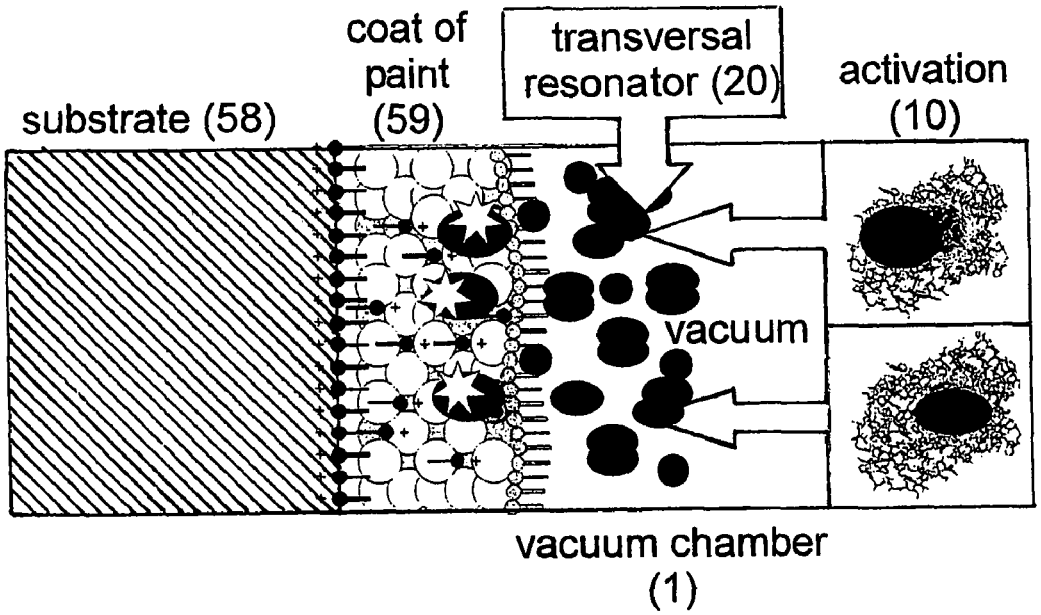
Figure 10:
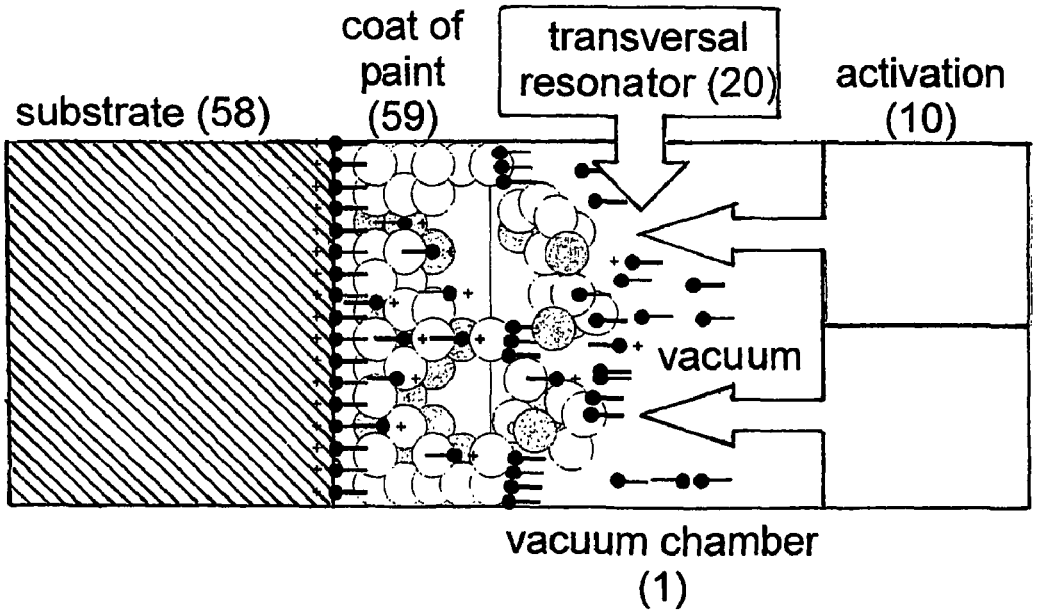

Now the individual phases of the multiphase process are described and explained below individually: FIG. 5 shows the phase 1 of that: In the multiphase process, organic layers are removed from the backside and built up from the front side for the layer formation. Therefore, for layer removal in the phase 1, the organic layer is provided with a hollow space structure, i.e. it is made porous. For that purpose, gas-loaded nanoparticles are accelerated in the direction of the substratum surface with accumulated chiral molecules from the aerosol mixture produced in the transversal resonator in a polar, transversal alternating field. For this, a potential difference of $\Delta_{\phi 0}$=3000 V and a superimposed alternating voltage of 4000V are applied between the two electrodes (Wave guide) of the transversal resonator. In the alternating field, the energy levels of the nanoparticle phase boundary layers are periodically raised and lowered. The injection process is accelerated by that. The channel walls of the microchannels produced by the penetration of the gas-loaded nanoparticles are occupied by chiral molecules. This process is performed by a tandem reaction. This is a reaction sequence in which two different reactions follow each other directly, in which the first reaction practically forces the injection, the second, the occupation of the channel walls. The capillaries produced thus remain stable for about 30 to 60 seconds.

Phase 2: (FIG. 6) An injection process occurs in the direction of the substrate or the organic layer adhering to the substrate through the modification of the electrical double layer on the nanoparticles $M_2$. A potential drop arises at the phase transition (Aerosol/Liquid) ↔ (Layer) and with that a modification of the resonance frequency at the particle surface $M_2$. So that the potential of the particle double layer is matched to the chiral molecules in the injection channel, at first a polar field adapted to the electric current potential is built up, which produces in the microcapillaries a stationary velocity field with an asymmetric potential distribution. For that, a potential difference of $\Delta_{\phi 0}$=500 V is applied in the transversal resonator between the two electrodes (Wave guide). The dimensionless potential at the substrate then amounts to $\phi_{11}$=1 and at the walls $\phi_{21}$=0. The particles $M_2$ flow through the microcapillaries formed in phase 1 in the direction of the substrate surface by the asymptotic adaptation to the electrical boundary condition and the rotating field, which is formed by the rotation of the two electrodes (Wave guide). Having arrived there, they transfer a part of the kinetic energy to the phase surface "Substrate ↔ Layer", where they form a molecular separating layer through the local modification of the Zeta potential.

Phase 3*a*: (FIG. 7) In the Phase 3*a*, non-ionic molecules are accumulated on the outside of the organic layer. After a molecular occupation of the outer boundary layer, the surface energy is increased. The boundary layer curves in a concave shape towards outside. Simultaneously, amphoteric molecules diffuse in the still open capillaries. After the loss of their kinetic energy, they remain stuck in the layer system. A distribution arises in the layer system through the different amounts of kinetic energies of the individual amphoteric molecules. Phase 3*b*: (FIG. 8) The energy-deficient amphoteric molecules resonant in a high frequency energy field and changes into anions. Simultaneously, they form a network of small areas through which crack-shaped capillaries arise in the organic layer, in which the active materials are transported to the anions in the Phase 4.

Phase 4: (FIGS. 9 and 10) In Phase 4, the method "Phase transfer catalysis" is used. This enables reactions between substances, which are in different non-mixable phases. Nothing happens by the contact of the anionic phase $M_x$ with the enzyme phase $M_y$ loaded with nanoparticles. The reaction occurs only if an ion extracts from the phase $M_x$ through the interface $M_{x,y}$ to the phase $M_y$. Then, a vigorous reaction arises in the phase space $M_{x,y}$ through the catalytic action of the enzymes, which causes in the double layer a potential jump at the interface of the nanoparticles. This potential jump leads to an instability of the phase space $M_{x,y}$, the consequence of which is that the phase space cells decompose within a few microseconds to their components. Isolated, large, energetic centres arise in the organic layer through the bonding energy released thereby, which lead to the chipping of large areas (for example, colour agglomerations) in the organic layer in the macro area.

Basically no materials are dissolved with the given cleaning process. According to the process stage, mixtures arise, which degenerate partially by itself or under the influence of the process. It is common to all these processes that, for the achievement of the desired effect, interaction forces must exist between the equal and unequal partners. The bandwidth for the possible uses of the process is very large. It can be used with a suitable microemulsion, not only for coating removals, but also for coatings. This is possible through the specific production of desired double layers with a suitable matrix. Primarily, the possible modifications of physical properties and the self-organisation of the nanoparticles as well as the properties of double layers are used in the process. Consequently, systems can be built up which achieve a large effect for the least energy expenditure possible. Besides the physical modifications in double layers, specific chemical modifications can also be produced with the process. The process can be used likewise for the forming of molecular layers with new solid properties in the nano range.

The invention claimed is:

1. A device for the production, application and recycling of nanoemulsions as well as for the surface treatment of parts by means of the same, consisting of a closed loop with minimum one pump (9) for the supply of an emulsion to a circuit, this closed loop containing a vacuum chamber (1) for the surface treatment of parts therein, in which the closed loop runs through an actuation device (10), as well as a high voltage electrode (23) and a high frequency coil (27) with separate generator each with frequency converter for the production of an electrical field, in which separate fields can be produced by said actuation device for the conversion of a microemulsion to a nanoemulsion, and the device further including a transversal resonator (20) for the production of an aerosol/emulsion mixture as well as injection nozzles (34) for the spraying of the aerosol into the vacuum chamber (1).

2. The device for the production, application and recycling of nanoemulsions as well as for the surface treatment of parts by means of the same according to claim 1 characterised by the fact that the device has said generators for the operation of the electrode and the coil as well as phase discriminators, in which high voltage fields of 1 to 10,000 Volt can be produced by means of these generators with superimposed frequencies from 10 Hz to 1 GHz.

3. The device for the production, application and recycling of nanoemulsions as well as for the surface treatment of parts by means of the same according to claim 1 characterised by the fact that the vacuum chamber (1) is fitted with a vacuum valve (18) for setting the vacuum chamber (1) under vacuum and for leading away the exhaust air via the opening (6) in the housing of the device and further that the device has a 3/2 directional control valve (19) for the aeration and deaeration of the recycling system (5) as well for the aeration of the vacuum chamber (1).

4. The device for the production, application and recycling of nanoemulsions as well as for the surface treatment of parts by means of the same according to claim 3, characterised by the fact that the device has one or more circulation pumps (9), to whose outlets one actuation device (10) each is connected and which is/are connected via a screwing with an inserted transversal resonator (20) to the vacuum chamber (1) as cleaning tub, on whose floor there is a drain outlet, which is connected to the pump inlets via a T-joint (11) and a threaded connection each.

5. The device for the production, application and recycling of nanoemulsions as well as for the surface treatment of parts by means of the same according to claim 4, characterised by the fact that the device contains a circuit for the recycling and the two actuation devices (10) are connected to each other via a connecting tube (12), in which there is a valve (13) in its middle via which a part of the emulsion can be fed to the recycling system (5) for the recycling via the tube (14), as well as a pipe (15) and a valve (16) for the-recirculation of the cleaned microemulsion to the vacuum chamber (1).

6. The device for the production, application and recycling of nanoemulsions as well as for the surface treatment of parts by means of the same according to claim 5, characterised by the fact that the actuation device (10) includes a shielding housing (21) and consists of a pipe, which is connected to the floor outlet of the vacuum chamber (1) in which an insulator (22) is assembled in the shielding housing (21) and in the middle of the insulator (22), that is in the liquid inlet, there are minimum one high voltage electrode (23) and two sliding contacts (24) for the connection with the wave guides (25), and that an electromagnetic high frequency coil (27) is fitted outside the shielding housing (21) and there is a ball bearing (28) and a fastening thread for the transversal resonator (20) in the upper part of the insulator (22), which projects into the vacuum chamber, as well as the connection for the high voltage electrode (23) at the lower end, below the high frequency coil (27), and an inlet (30) is present via which gaseous, vaporous or liquid active agents can be supplied to the system.

7. The device for the production, application and recycling of nanoemulsions as well as for the surface treatment of parts by means of the same according to claim 6, characterised by the fact that the transversal resonator (20) consists of a cylindrical rotating part (31) of plastic or ceramic with internal thread for the fixing to the actuation device (10) and has two threads provided sideways for hollow nozzle bars (32) of plastic, in which one or more ring permanent magnets (33) are assembled in the upper part, and one or more injection nozzles (34) are screwed on the hollow nozzle bars (32) each, as well as one wave guide (25) each of tungsten or stainless steel is fixed in the lower third, in the middle of the hollow nozzle bars (32) or in the region in-between, which are closed on the outer side with a permanent magnet and are connected on the inner side with each via a sliding contact (24) to the actuation device (10).

8. The device for the production, application and recycling of nanoemulsions as well as for the surface treatment of parts by means of the same according to claim 7, characterised by the fact that the recycling system (5) contains a separation plate (49), which is fixed by a T-shaped fixing unit (54) to a sealing ring (55) on the pot floor and consists of a metal tray (50) with discharge holes, to which a stainless steel nose plate (51) is fixed as spacer, and that a Piezo foil (52) or electrode consisting of a wire gauze lies on the nose plate, which can be supplied with high voltage by an external generator and a fine-mesh stainless steel grid (53) lies over the electrode, in which these parts put in are fixed at the rim with a high-ohmic sealing compound (56) insulated against the metal tray (50).

* * * * *